US007359663B2

(12) United States Patent
Inui et al.

(10) Patent No.: US 7,359,663 B2
(45) Date of Patent: Apr. 15, 2008

(54) IMAGE FORMING APPARATUS

(75) Inventors: Hiroshi Inui, Osaka (JP); Takuya Eto, Osaka (JP)

(73) Assignee: Kyocera Mita Corporation (JP)

( * ) Notice: Subject to any disclaimer, the term of this patent is extended or adjusted under 35 U.S.C. 154(b) by 142 days.

(21) Appl. No.: 11/326,732

(22) Filed: Jan. 5, 2006

(65) Prior Publication Data

US 2007/0019998 A1 Jan. 25, 2007

(30) Foreign Application Priority Data

Jul. 22, 2005 (JP) ..... 2005-213359
Nov. 1, 2005 (JP) ..... 2005-317966

(51) Int. Cl.
*G03G 15/01* (2006.01)

(52) U.S. Cl. ..... 399/302; 399/299; 399/306; 399/308

(58) Field of Classification Search ..... 399/298, 399/299, 300, 302, 303, 306
See application file for complete search history.

(56) References Cited

U.S. PATENT DOCUMENTS 5,619,310 A * 4/1997 Todome ..... 399/381
6,546,220 B1 * 4/2003 Asakura et al. ..... 399/227
2003/0086732 A1 * 5/2003 Abe et al. ..... 399/302
2004/0184828 A1 * 9/2004 Bannai et al. ..... 399/301
2005/0249524 A1 * 11/2005 Matsuda et al. ..... 399/167

FOREIGN PATENT DOCUMENTS

JP 10-339984 12/1998

* cited by examiner

*Primary Examiner*—David M. Gray
*Assistant Examiner*—Ryan D. Walsh
(74) *Attorney, Agent, or Firm*—Gerald E. Hespos; Anthony J. Casella

(57) ABSTRACT

An image forming apparatus has a plurality of developing units for developing toner images of different colors, an intermediate transfer belt for transferring the toner images of the respective colors onto a surface of the belt or onto a recording sheet transported over the belt surface, a first or drive roller for driving the belt while the belt is wound around the first roller, a second or driven roller and a tension roller, which is driven along with the driving of the belt driven by the first roller. The image forming apparatus satisfies a relation defined by the following equation:

$$D2=N\cdot D1$$

where D1 is a belt-inclusive outer diameter of the first roller where the belt is wound, including the thickness t of the belt, D2 is an outer diameter of the second roller, and N=n or 1/n where n is a positive integer.

3 Claims, 7 Drawing Sheets

IMAGE FORMING APPARATUS

BACKGROUND OF THE INVENTION

1. Field of the Invention

The present invention relates to an image forming apparatus such as a printer and a copier, and more particularly to an image forming apparatus for forming a color image by superimposing toners of different colors.

2. Description of the Related Art

In recent years, an image forming apparatus such as a printer and a copier provided with a color printing function has been widespread. In color printing, a color image is formed by superimposing toners of different colors such as yellow (Y), magenta (M), cyan (C), and black (K), for instance. In forming a color image, there is known a so-called tandem color system e.g. a color printer, in which a transfer belt unit is provided, and imaging sections for forming images of the respective colors are arranged along the longitudinal direction of a transfer belt. Normally, the transfer belt unit is provided with two or more rollers for supporting the transfer belt or driving the transfer belt. Hereinafter, the rollers constituting the transfer belt unit are called as "belt constituting rollers". The belt constituting rollers are classified into a drive roller for driving the transfer belt, a driven roller for supporting the transfer belt, a tension roller for applying a tension to the transfer belt, and the like. In the above construction, a color image is formed on the surface of the transfer belt by superimposed and successive transferring of toner images of four different colors i.e. YMCK by photosensitive drums of the respective imaging sections in accordance with a driving rotation of the drive roller. This image forming operation is called as a primary transfer operation. After the primary transfer operation, the color image formed on the belt surface is transferred onto a recording sheet by secondary transfer rollers disposed opposed to the respective photosensitive drums with respect to the transfer belt. This transfer operation is called as a secondary transfer operation.

In the tandem color system, generally, it is difficult to properly superimpose toner images of the respective colors (hereinafter, the color superimposition is sometimes called as "color tuning"), and color displacement or color unevenness, which are hereinafter called as "color displacement" collectively, is likely to occur. Fluctuation of a running speed of the transfer belt is one of the factors of making color tuning difficult. Various parameters such as fluctuation of an outer diameter of the drive roller, fluctuation of a thickness of the transfer belt, or vibration of a gear in a driving section are some of the causes of the fluctuation of the running speed of the transfer belt.

SUMMARY OF THE INVENTION

It is an object of the present invention to provide an image forming apparatus which has overcome the aforementioned problems residing in the prior art.

According to an aspect of the invention, an image forming apparatus for forming a color image composed of a plurality of colors comprises: a plurality of developing units for developing toner images of the respective colors; a transfer belt for superimposedly transferring the toner images of the respective colors developed by the developing units onto a surface of the transfer belt or onto a recording sheet transported over the surface of the transfer belt; a first roller for driving the transfer belt in a state that the transfer belt is wound around the first roller; and a second roller which is rotated along with the driving of the transfer belt driven by the first roller in a state that the transfer belt is wound around the second roller, wherein the image forming apparatus satisfies a relation defined by the equation (1.1)

$$D2=N\cdot D1 \tag{1.1}$$

where D1 is a belt-inclusive outer diameter of the first roller around which the transfer belt is wound, including a thickness of the transfer belt, D2 is an outer diameter of the second roller, and N=n or 1/n where n is a positive integer.

In the above arrangement, the toner images of the respective colors are developed by the developing units, and the toner images of the respective colors developed by the developing units are transferred onto the surface of the transfer belt or onto the recording sheet transported over the surface of the transfer belt. Also, the transfer belt is driven in a state that the transfer belt is wound around the first roller, and the second roller is driven along with the running of the transfer belt driven by the first roller in a state that the transfer belt is wound around the first roller. The image forming apparatus satisfies the relation defined by the equation (1.1) where D1 is the belt-inclusive outer diameter of the first roller around which the transfer belt is wound, including the thickness of the transfer belt, and D2 is the outer diameter of the second roller.

According to the above arrangement, the cycle of rotational fluctuation of the first roller as a master roller can be made coincident with the cycle of rotational fluctuation of the second roller as a slave roller, in other words, timings of fluctuation cycles of the first roller and the second roller can be made coincident with each other. Accordingly, even if color unevenness occurs in a toner image of a certain color during a transfer operation due to rotational fluctuation of a belt constituting roller such as the first roller and the second roller, color unevenness occurs substantially at the same positions of the toner images of the other colors as that of the toner image where the color unevenness occurred, i.e., substantially at the same timings. This arrangements enables to prevent occurrence of color displacement resulting from rotational fluctuation of the belt constituting roller, whereby a color image of high quality is obtained.

These and other objects, features and advantages of the present invention will become more apparent upon reading of the following detailed description along with the accompanying drawings.

DETAILED DESCRIPTION OF THE PREFERRED EMBODIMENTS

Figure 1:
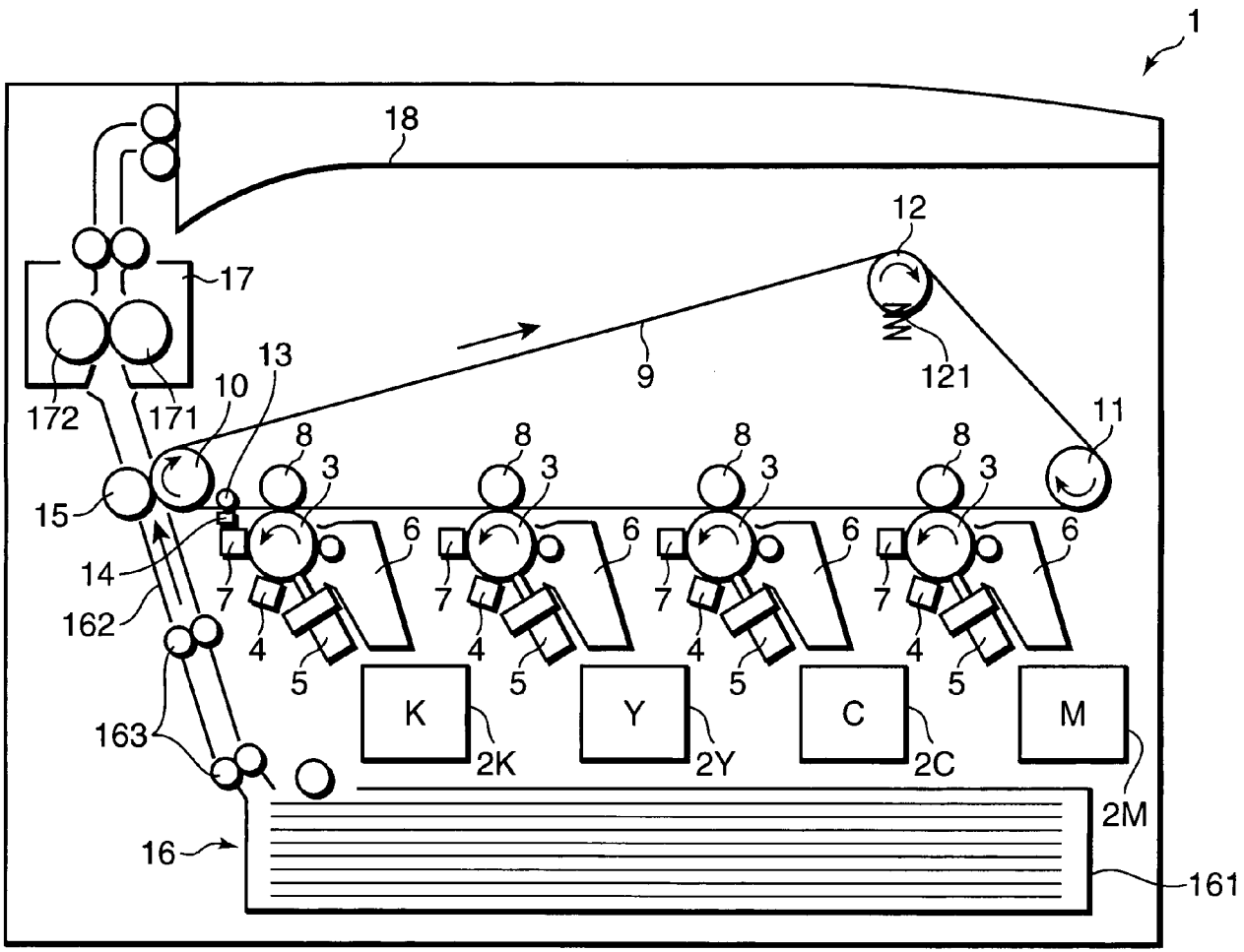
FIG. 1 is a cross-sectional view showing a schematic arrangement of a printer in accordance with an embodiment of the invention.

In the following, a printer as an example of an image forming apparatus in accordance with the invention is described referring to the drawings. FIG. 1 is a cross-sectional view showing a schematic construction of the printer. As shown in FIG. 1, a main body of the printer 1 is incorporated with imaging sections 2M, 2C, 2Y, and 2K for forming images of magenta (M), cyan (C), yellow (Y), and black (K), respectively. The imaging sections 2M, 2C, 2Y, and 2K are adapted to form e.g. print a color image or a monochromatic image on a recording sheet. Each of the imaging sections 2M, 2C, 2Y, and 2K includes a photosensitive drum 3 which is composed of e.g. amorphous silicon and is made rotatable in the direction shown by the arrow in FIG. 1, a charging unit 4, an exposure unit 5, a developing unit 6, a cleaning unit 7, and the like.

The charging unit 4 charges the surface of the photosensitive drum 3 to a certain potential uniformly. The exposure unit 5 is a so-called laser scan unit, and emits a laser beam i.e. LED light generated based on image data sent from an image data storage 30 or the like, which will be described later, onto the surface of the photosensitive drum 3 to form an electrostatic latent image on the drum surface. The developing unit 6 attracts toner supplied from a toner supplier 61 in the developing unit 6 to the electrostatic latent image formed on the drum surface to develop the latent image into a toner image. The cleaning unit 7 removes toner residuals on the drum surface after a primary transfer operation of transferring the toner image onto a surface of an intermediate transfer belt 9, which will be described later.

Intermediate transfer rollers 8 corresponding to primary transfer rollers, and the intermediate transfer belt 9 (hereinafter, called as "the belt 9" or "the endless belt 9") are provided above the imaging sections 2M, 2C, 2Y, and 2K to perform an intermediate transfer operation corresponding to the primary transfer operation of transferring the toner image developed on the drum surface onto the surface of the belt 9. The belt 9 is constituted of a certain belt member which is wound around a drive roller 10, a driven roller 11, and a tension roller 12. The belt 9 is endlessly run by the drive roller 10, the driven roller 11, and the tension roller 12 in a state that the belt 9 is pressed against the photosensitive drums 3 by the intermediate transfer rollers 8 which are arranged opposed to the corresponding photosensitive drums 3 with respect to the belt 9.

The drive roller 10 is a master roller which drivingly rotates by a drive source such as a drive motor, and applies a driving force to the belt 9 to run the belt 9 endlessly. The driven roller 11 is made rotatable, and is rotated along with the driving of the endless belt 9 by the drive roller 10. In other words, the driven roller 11 is a roller which is rotated via the belt 9 by the rotation of the drive roller 10, and rotatably supports the belt 9. The tension roller 12 is made rotatable as well as the driven roller 11, is rotated via the belt 9 by the rotation of the drive roller 10, rotatably supports the belt 9, and applies a tension to the belt 9 so that the belt 9 may not be loosened. The tension roller 12 applies a pressing force to the belt 9 in an upward direction from an inner surface of the belt 9 corresponding to a lower surface thereof to an outer surface of the belt 9 corresponding to an upper surface thereof when an urging force is applied to the tension roller 12 by an urging member 121 such as a spring member to thereby generate the tension.

Figure 5:
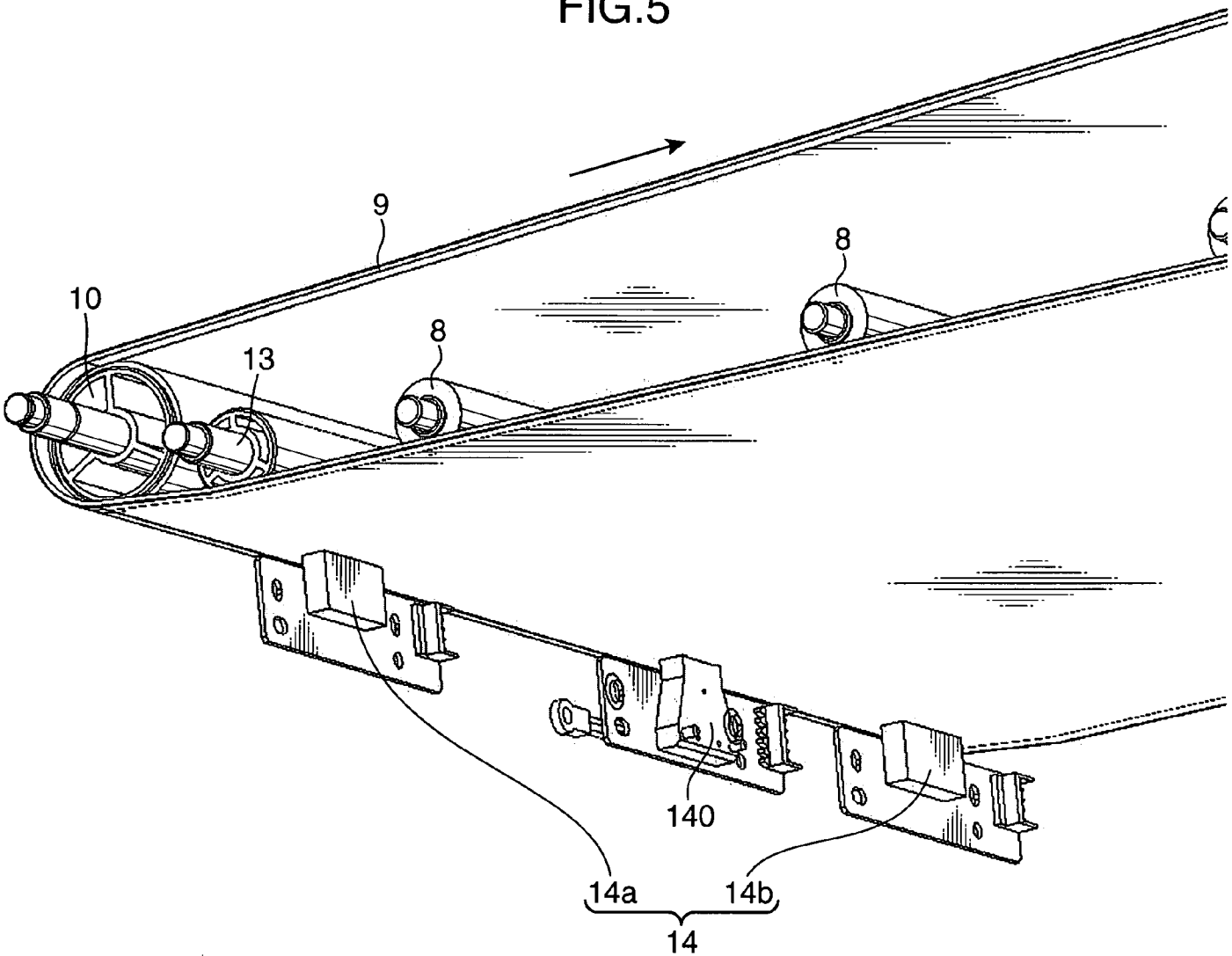
FIG. 5 is an enlarged detailed illustration of a backup roller, a belt position sensor, and their periphery.

A backup roller 13 and a belt position sensor 14 are provided at respective predetermined positions relative to the belt 9, in this embodiment, between the drive roller 10 and the intermediate transfer roller 8 of the imaging section 2K. Specifically, the backup roller 13 and the belt position sensor 14 are respectively arranged on the sides of the inner surface and the outer surface of the belt 9 upstream relative to a secondary transfer position, near the drive roller 10. FIG. 5 is an enlarged detailed illustration of the backup roller 13, the belt position sensor 14, and their periphery. The backup roller 13 is provided to keep a distance between the belt position sensor 14 and the belt 9 constant. As shown in FIG. 5, the backup roller 13 is pressed against the belt 9 with a proper pressing force being applied thereto in a downward direction from the inner surface of the belt 9 to the outer surface thereof. In this arrangement, there is no likelihood that the distance between the belt 9 and the belt position sensor 14 may be varied due to undulation of the belt 9 or a like phenomenon, which may cause an error in detecting the position of the belt 9.

Figure 6:
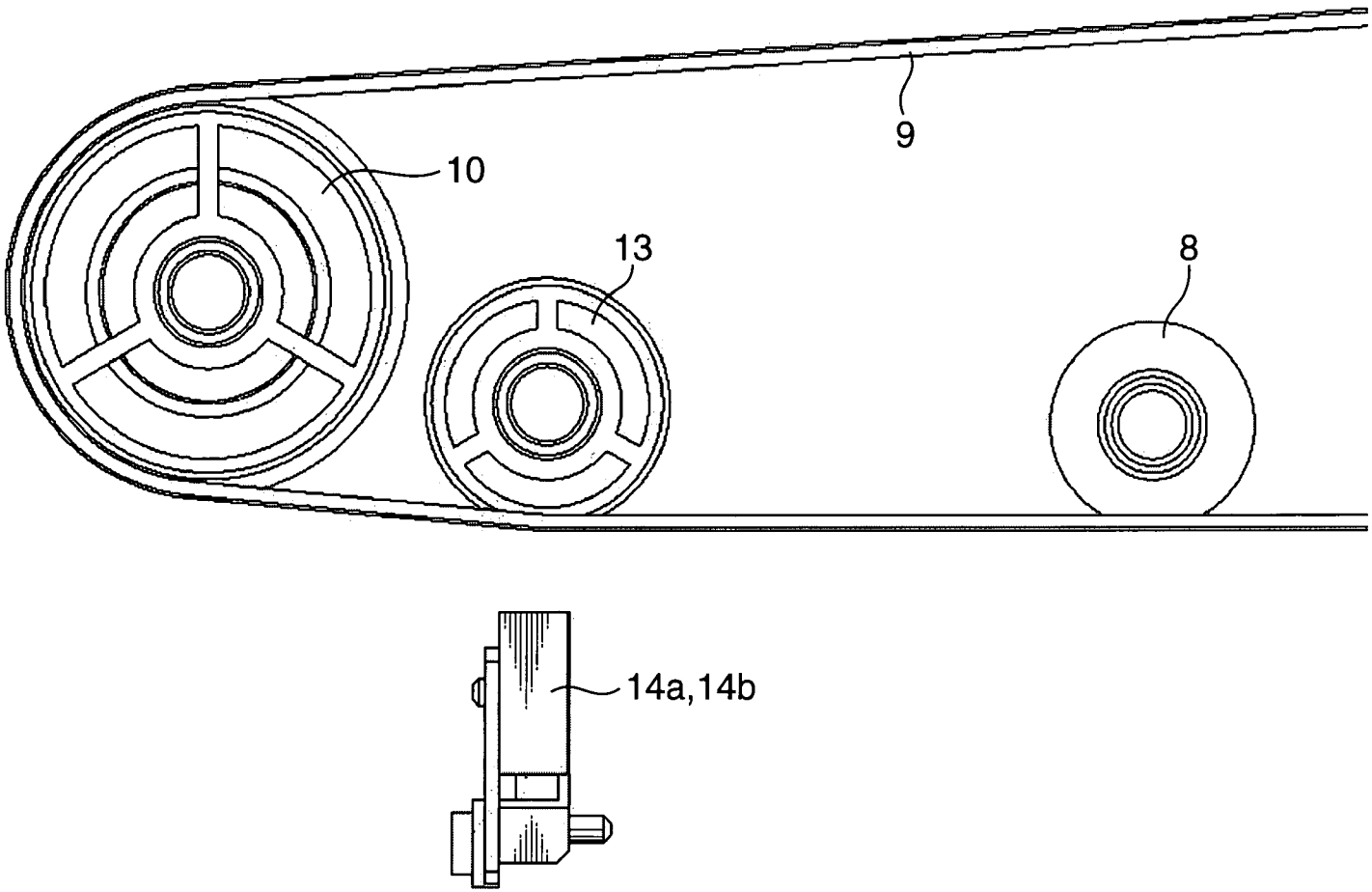
FIG. 6 is an enlarged detailed illustration of the backup roller, the belt position sensor, and their periphery.

The belt position sensor 14 is a sensor for detecting information for determining the position of the endless belt 9. The belt position sensor 14 is constituted of a pair of a first position sensor 14*a* and a second position sensor 14*b* which are arranged in a widthwise direction of the belt 9. As shown by a side view in FIG. 6, the first position sensor 14*a* and the second position sensor 14*b* are arranged linearly in the widthwise direction i.e. in a direction orthogonal to the running direction of the belt 9 away from the belt 9 by a certain distance. Providing the belt position sensor 14 in pair away from each other in the widthwise direction of the belt 9 enables not only to detect positional displacement of the belt 9 in the running thereof but also to detect positional displacement of the belt 9 in an oblique direction thereof to thereby accurately detect the position of the belt 9. Specifically, the first position sensor 14*a* (or the second position sensor 14*b*) is constituted of a photo sensor such as a reflective photo sensor, and is adapted to acquire information for determining the position of the belt 9 by making a mark on the outer surface of the belt 9 and by causing the photo sensor to detect the mark. Alternatively, it is possible to form predetermined images e.g. toner images of the respective colors on the surface of the belt 9 for determining the position of the belt 9, and to detect the images by the photo sensors.

A density sensor 140 may be provided near the belt position sensor 14, in this embodiment, at a position substantially in the middle of the first and the second position sensors 14*a* and 14*b*, as shown in FIG. 5. The density (ID) sensor 140 is adapted to detect information relating to color densities of the respective toner images formed on the surface of the belt 9 to know the respective colors. Density correction or calibration is performed based on the color density information.

Figure 7:
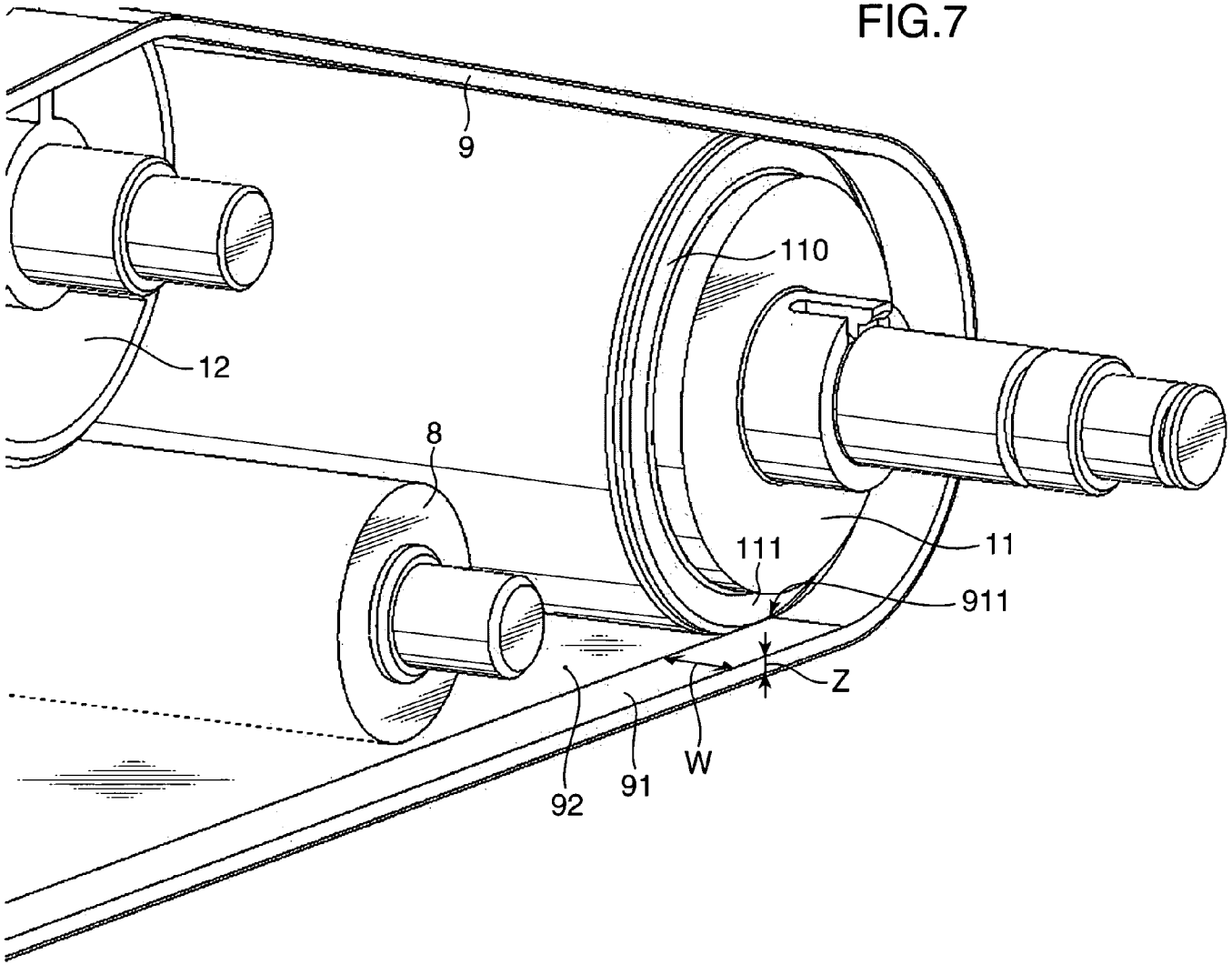
FIG. 7 is an enlarged detailed illustration of the intermediate transfer belt, a driven roller, and their periphery for describing an anti-skew rib and an anti-skew pulley.

As shown in FIG. 7, an anti-skew rib 91 is integrally formed with a main body 92 of the belt 9 over the inner surface of the belt 9 in the longitudinal direction thereof. The anti-skew rib 91 is formed at widthwise opposite ends of the belt 9. The anti-skew ribs 91 are made of a material, which is unlikely to cause slipping, in other words, which has a large frictional force relative to an anti-skew pulley 110 made of a resin e.g. polyurethane rubber, which will be described later. Each of the anti-skew ribs 91 has a certain width W and a thickness Z. The thickness t of the belt main body 92 is e.g. about several hundred microns, and the thickness Z of the anti-skew rib 91 is e.g. about 2 mm. The anti-skew pulleys 110 each having a flange-like portion are fixedly attached to longitudinal opposite ends of the driven roller 11 i.e. in the widthwise direction of the belt 9 in correspondence to the anti-skew ribs 91, respectively. Each of the anti-skew pulleys 110 is engaged with the corresponding anti-skew rib 91, with an outer surface 111 of the anti-skew pulley 110 being contacted against an inner wall 911 of the anti-skew rib 91. In other words, the anti-skew pulleys 110 attached to the longitudinal opposite ends of the driven roller 11 are held or guided by the anti-skew ribs 91 formed on the widthwise opposite ends of the belt 9, whereby the running of the endless belt 9 is stabilized, and skew running of the belt 9 is prevented. Alternatively, the anti-skew pulleys 110 may be attached to the tension roller 12 or the drive roller 10.

Four different colors of M, C, Y, and K are used to perform color printing by the printer 1, or monochromatic printing may be performed by using the color K In color printing, toner images of the colors are formed on the surfaces of the photosensitive drums 3 of the imaging sections 2M, 2C, 2Y, and 2K, respectively. The toner images formed on the surfaces of the photosensitive drums 3 are sequentially and superimposedly transferred onto the surface of the endless belt 9 synchronously with each other in the order of magenta, cyan, yellow, and black, namely, in a state that positions of the respective toner images e.g. end portions of the respective toner images are made coincident with each other. This image forming operation corresponds to a primary transfer operation. By conducting the primary transfer operation, a color image composed of the toner images of M, C, Y, and K is formed on the surface of the belt 9. The color image formed on the surface of the belt 9 is carried to the position of the drive roller 10 by the endless belt 9. When the color image is carried to the position of the drive roller 10, the color image is transferred onto a recording sheet transported to the drive roller 10 from a sheet feeding section 16, which will be described later, by a secondary transfer roller 15 which is arranged opposed to the drive roller 10 with respect to the belt 9. This transfer operation corresponds to a secondary transfer operation.

The printer 1 has the sheet feeding section 16 for feeding a recording sheet toward the imaging sections 2M, 2C, 2Y, and 2K The sheet feeding section 16 includes a sheet cassette 161 each adapted to accommodate recording sheets of a certain size, a transport path 162 along which a recording sheet is transported, a transport roller 163 for transporting the recording sheet in the transport path 162, and the like. A recording sheet dispensed from the sheet cassette 161 is transported to a nip portion between the secondary transfer roller 15 and the belt 9. The sheet feeding section 16 is also adapted to transport the recording sheet after the secondary transfer operation to a fixing section 17, which will be described later, and to discharge the recording sheet after the image fixation onto a sheet discharge tray 18 provided on an upper part of the printer main body.

The fixing section 17 is provided at an appropriate position downstream relative to the secondary transfer roller 15 in the sheet transport direction of the transport path 162. The fixing section 17 is adapted to fix the toner image transferred onto the recording sheet. The fixing section 17 includes a heater roller 17 and a pressure roller 172, and the toner of the color image on the recording sheet is fused by the heat of the heater roller 171, and the color image on the recording sheet is fixed by a pressure applied from the pressure roller 172.

Figure 2:
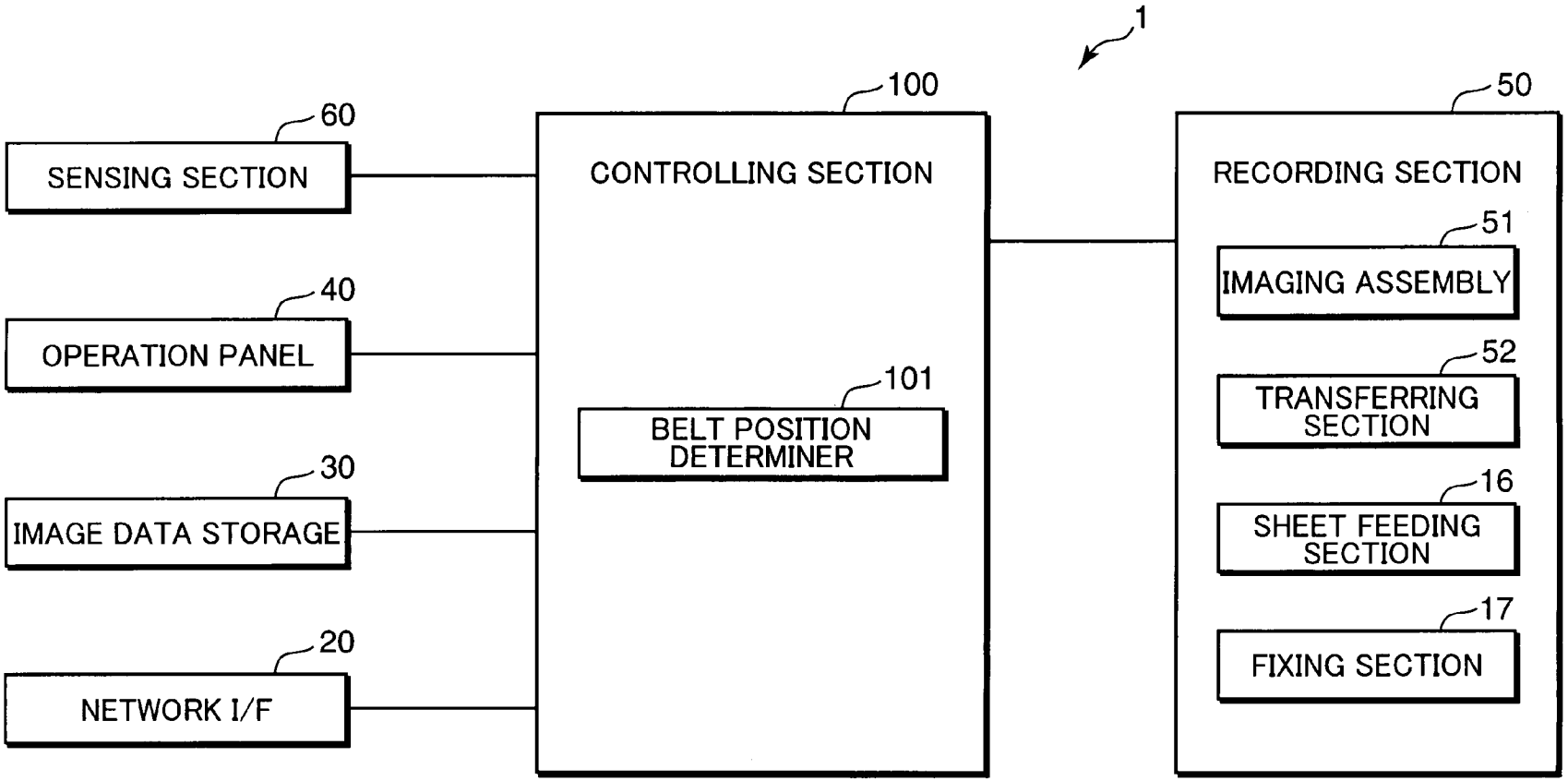
FIG. 2 is a block diagram showing an example of a schematic arrangement of the printer shown in FIG. 1.

FIG. 2 is a block diagram showing an example of a schematic arrangement of the printer 1. As shown in FIG. 2, the printer 1 includes a network interface (I/F) 20, the image data storage 30, an operation panel 40, a recording section 50, a sensing section 60, and a controlling section 100. The network I/F 20 controls sending and receiving various data to and from an external device i.e. an information processor such as a personal computer (PC), which is connected to the printer 1 via a network such as a local area network (LAN). The image data storage 30 temporarily stores image data which has been sent from the PC or a like device via the network I/F 20. The operation panel 40 is formed at a front part of the printer 1, and is functioned as an enter key section through which various operational commands are entered by a user, or is functioned to display various information. The sensing section 60 is constituted of various sensors such as the belt position sensor 14, and is adapted to detect operative states of the various parts of the printer 1.

The recording section 50 is adapted to print an image on a recording sheet based on the image data stored in the image data storage 30 or the like. The recording section 50 includes an imaging assembly 51, a transferring section 52, the sheet feeding section 16, and the fixing section 17. The imaging assembly 51 is constituted of the imaging sections 2M, 2C, 2Y, and 2K each comprised of the photosensitive drum 3, the charging unit 4, the exposure unit 5, the developing unit 6, and the cleaning unit 7, and is adapted to form toner images on the photosensitive drums 3, as described referring to FIG. 1. The transferring unit 52 includes the intermediate transfer rollers 8, the belt 9, the drive roller 10, the driven roller 11, the tension roller 12, the backup roller 13, and the secondary transfer roller 15. As described referring to FIG. 1, the transferring unit 52 is adapted to transfer a toner image, which is either a color image or a monochromatic image formed on the photosensitive drum 3, onto the recording sheet by way of the belt 9.

The controlling section 100 includes a Read Only Memory (ROM) for storing various control programs, a Random Access Memory (RAM) which is adapted to temporarily store data or is functioned as a work area, and a microcomputer for reading out the control program or the like read out from the ROM to execute the program. The controlling section 100 controls overall operations of the printer 1 by sending and receiving various control signals to and from the respective functional parts. The controlling section 100 has a belt position determiner 101.

The belt position determiner 101 is adapted to determine the position of the belt 9 based on the information detected by the belt position sensor 14. The controlling section 100 may be operated in such a manner that the position of the belt 9 determined by the belt position determiner 101 is used to detect, for instance, a timing for forming a toner image on the belt 9, or for performing a secondary transfer operation of the toner image, or to detect the position of the belt 9 where a failure such as fluctuation of a running speed of the belt 9 is supposed to have occurred.

As described in the section of Description of the Related Art, in a tandem color system, fluctuation may occur in a rotating cycle of the belt constituting roller (hereinafter, the fluctuation of the rotating cycle is called as "rotational fluctuation"). The rotational fluctuation may give arise to fluctuation of a running speed of the belt 9. In this section, description is made on a technique as to how an influence to color tuning of toners due to occurrence of rotational fluctuation of the belt constituting roller is eliminated or removed. Eliminating or removing an influence to the color tuning resulting from rotational fluctuation of the belt constituting roller is expressed as cancellation of rotational fluctuation hereinafter.

Figure 3:
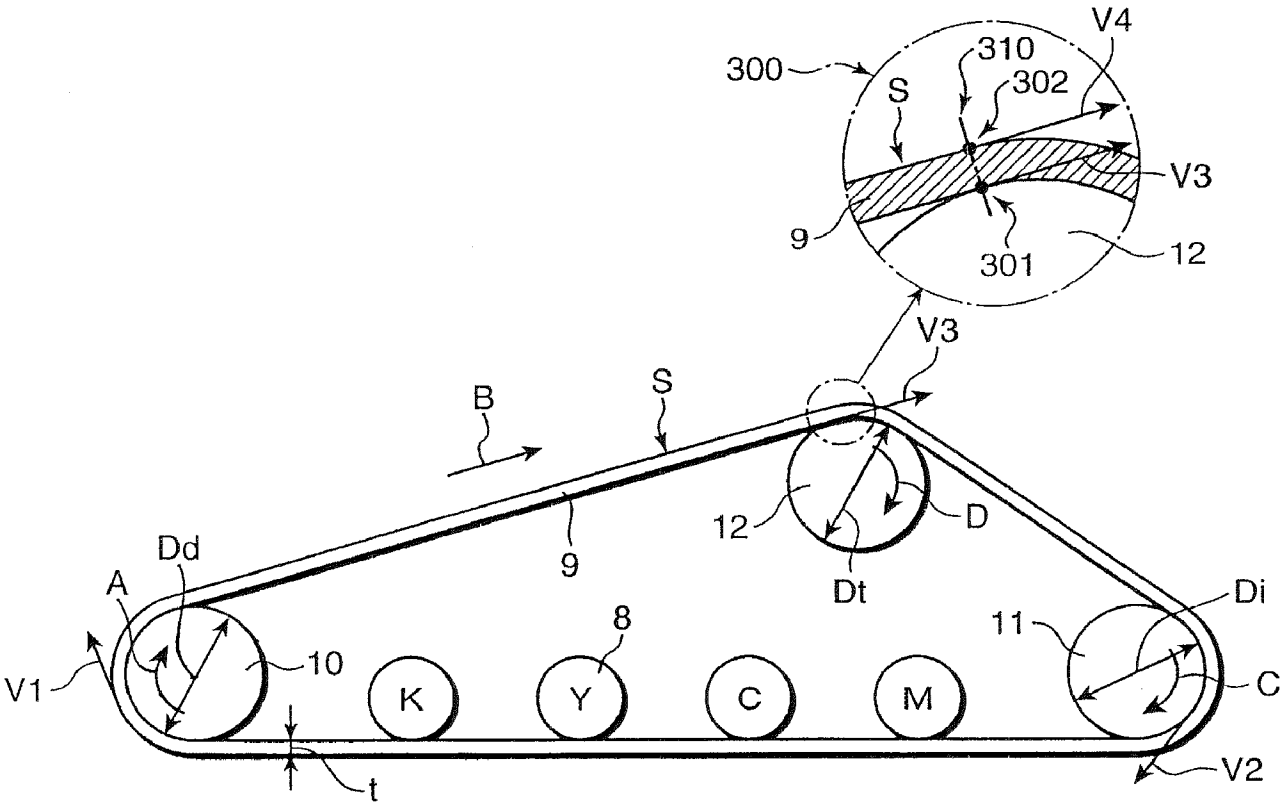
FIG. 3 is an illustration conceptually showing an intermediate transfer belt, and belt constituting rollers to describe a mechanism of canceling rotational fluctuation of the belt constituting rollers.

FIG. 3 is a schematic illustration conceptually showing the belt 9, and the belt constituting rollers comprised of the drive roller 10, the driven roller 11, and the tension roller 12 shown in FIG. 1 to describe the cancellation of rotational fluctuation of the belt constituting rollers. Dd is an outer diameter of the drive roller 10, Di is an outer diameter of the driven roller 11, Dt is an outer diameter of the tension roller 12, and t is a thickness of the belt 9. The intermediate transfer rollers 8 with symbols M, C, Y, and K represent the intermediate transfer rollers 8 of the respective corresponding imaging sections 2M, 2C, 2Y, and 2K.

As shown in FIG. 3, the drive roller 10, the driven roller 11, and the tension roller 12 are arranged at respective predetermined positions on the inner side of the belt 9 in a state that each of the rollers 10, 11, and 12 is pressed against the inner surface of the belt 9. When the drive roller 10 rotates in the direction shown by the arrow A, the belt 9 is endlessly run in the direction shown by the arrow B. As the belt 9 is run, the driven roller 11 and the tension roller 12 are driven in the directions shown by the arrows C and D, respectively.

In the above arrangement, it can be said that a cycle of rotational fluctuation by rotation of the drive roller 10, which gives an influence to the color tuning, occurs at a pitch of (Dd+2t), which corresponds to the sum of the outer diameter Dd of the drive roller 10 and double of the thickness t of the belt 9 wound around the drive roller 10, in view of the fact that each of the toner images is transferred onto the outer surface of the belt 9. Hereinafter, the cycle of rotational fluctuation of the belt constituting roller is called as "fluctuation cycle", and the pitch (Dd+2t) is called as "belt-inclusive outer diameter of the drive roller 10". On the other hand, the driven roller 11 and the tension roller 12 are in a so-called "idle relation" in light of the fact that the driven roller 11 and the tension roller 12 are rotated by way of the belt 9. Specifically, the driven roller 11 and the tension roller 12 are rotated because the rotating force of the drive roller 10 is transmitted to the driven roller 11 and the tension roller 12 by way of the belt 9 and the respective outer surfaces of the driven roller 11 and the tension roller 12. Accordingly, it can be said that fluctuation cycles of the driven roller 11 and the tension roller 12 occur at pitches of the respective outer diameters thereof i.e. Di and Dt.

In view of the above, the following relation as defined by the equation (1) is established, in which the pitches of the fluctuation cycles of the driven roller 11 and the tension roller 12 i.e. the roller outer diameters Di, Dt, equal to an integer multiplication or an inverse integer multiplication of the pitch of the fluctuation cycle of the drive roller 10 i.e. the belt-inclusive outer diameter of the drive roller 10, namely, (Dd+2t).

$$Di=Dt=N\cdot(Dd+2t) \tag{1}$$

where N is a coefficient, N=n or N=(1/n), and n is a positive integer.

The above equation (1) is derived from an idea of making a driven roller surface speed V2 and a tension roller surface speed V3 identical to a belt surface speed V1, wherein a running speed on the outer surface of the belt 9 where the drive roller 10 is provided is defined as the belt surface speed V1, a rotating speed on the outer surface of the driven roller 11 is defined as the driven roller surface speed V2, and a rotating speed on the outer surface of the tension roller 12 is defined as the tension roller surface speed V3, in other words, based on an idea of matching the surface speed of a slave roller with the surface speed of a master roller for driving the slave roller.

Running speeds on the inner surface and the outer surface of a straight portion S of the belt 9 are substantially identical to each other. For instance, as shown by a partially enlarged view indicated by the broken-line circle 300 in FIG. 3, the running speeds on the inner surface and the outer surface of the straight portion S are kept substantially the same until at least the belt 9 running in the direction shown by the arrow B reaches a position 310 where the belt 9 contacts the tension roller 12 substantially for the first time when the tension roller 12 is driven. Specifically, the tension roller surface speed V3 at an inner peripheral point 301 of the contact position 310 where the inner surface of the belt 9 contacts the tension roller 12 for the first time during rotation of the tension roller 12 is substantially made coincident with a surface speed V4 of the tension roller 12 at an outer peripheral point 302 of the contact position 310. Since the drive roller 10 is a so-called output element for driving the belt 9 forward by applying a driving force to the belt 9, it is necessary to apply the belt surface speed V1 on the outer surface of the belt 9 to the drive roller 10, in place of applying the circumferential speed on the outer surface of the drive roller 10. Since the tension roller 12 is a so-called input element which is rotated by way of the belt 9, the tension roller surface speed V3 (=V4) on the inner surface of the belt 9 by way of which the rotating force of the drive roller 10 is transmitted to the tension roller 12 is applied to the tension roller 12. The same idea is applied to the driven roller 11.

Assuming that r is a radius of rotation, ω is an angular velocity, D is a diameter, T is a cycle per rotation, R is the number of rotations per minute (rpm), generally, a circumferential velocity v is expressed by the following equation (2).

$$v=r\cdot\omega=(D/2)\cdot(2\pi/T)=(\pi\cdot D)/T=(\pi\cdot D\cdot R)/60 \tag{2}$$

Applying the equation (2) to the drive roller 10 and the driven roller 11, for instance, enables to yield the following equation (3) because V2=V1 as mentioned above. For sake of explanation, the order of V1 and V2 is opposite to the aforementioned description.

$$(\pi\cdot Di\cdot R2)/60=(\pi\cdot(Dd+2t)\cdot R1)/60 \tag{3}$$

where R2 is the number of rotations of the driven roller 11 per unit time, and R1 is the number of rotations of the drive roller 10 per unit time.

Removing the same coefficients and the like on the left and the right sides of the equation (3) enables to yield the following equation (4).

$$Di\cdot R2=(Dd+2t)\cdot R1 \tag{4}$$

Accordingly, a relation: Di=n (Dd+2t) or Di=(1/n)·(Dd+2t) is defined, wherein the relation satisfies the equation (4) and enables to make the fluctuation cycles of the drive roller 10 and the driven roller 11 identical to each other. The same idea is applied to the tension roller 12. Namely, Dt=n (Dd+2t) or Dt=(1/n). (Dd+2t). Expressing these relations altogether enables to yield the relation: Di=Dt=N (Dd+2t), as expressed by the equation (1).

If, in the case of the equation (1), for instance, Di=Dt=2·(Dd+2t) (N=2), wherein the outer diameters of the driven roller 11 and the tension roller 12 are twice as large as the belt-inclusive outer diameter of the drive roller 10, the equation (1) leads to a relation that the respective numbers of rotations of the driven roller 11 and the tension roller 12 become half as large as the number of rotations of the drive roller 10 by implementing the equation (4). Also, if, for instance, Di=Dt=(½)·(Dd+2t) (N=½), wherein the outer diameters of the driven roller 11 and the tension roller 12 are half as large as the belt-inclusive outer diameter of the drive roller 10, the equation (1) leads to a relation that the respective numbers of rotations of the driven roller 11 and the tension roller 12 become twice as large as the number of rotations of the drive roller 10 by implementing the equation (4). If N=1, the outer diameters of the driven roller 11 and the tension roller 12 are identical to the belt-inclusive outer diameter of the drive roller 10, and accordingly, the numbers of rotations of the drive roller 10, the driven roller 11, and the tension roller 12 become identical to each other.

In an actual printer, it is preferable to satisfy the relation: N=1 or ½, i.e., Di=Dt;1=(Dd+2t) or Di=Dt=(½)(Dd+2t). Production efficiency can be improved by making the diameters of the drive roller 10, the driven roller 11, and the tension roller 12 identical to each other. Also, it is possible to set the diameter of the drive roller 10 to e.g. 30 mm, and to set the diameters of the driven roller 11 and the tension roller 12 to 15 mm, which is half of the diameter of the drive roller 10, because there is no need of increasing the diameter of the driven roller 11 or the tension roller 12 in the aspect of reducing the weight or material cost.

As mentioned above, it is not always the case that the driven roller 11 and the tension roller 12 make one turn when the drive roller 10 makes one turn. However, since the numbers of rotations of the driven roller 11 and the tension roller 12 equal to an integral multiplication or an inverse integral multiplication of the number of rotations of the drive roller 10, there is no likelihood that phases of the fluctuation cycles of the driven roller 11 and the tension roller 12 relative to the fluctuation cycle of the drive roller 10 displace from each other.

Figure 4:
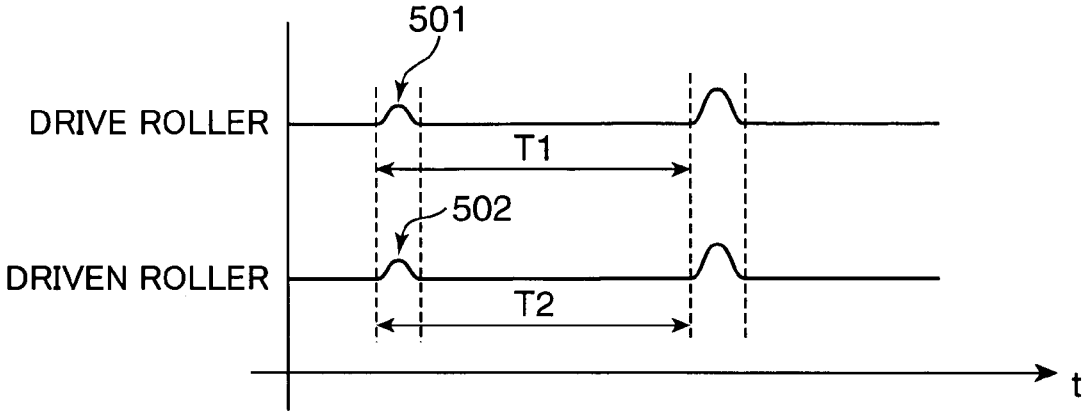
FIG. 4 is a timing chart concerning fluctuation cycles of the belt constituting rollers.

The above leads to the following. As shown by the timing chart concerning fluctuation cycles in FIG. 4, a time interval between a transfer abnormality e.g. color unevenness, which is a failure of toner transfer, and occurs as indicated by the reference numeral 501 due to rotational fluctuation of the drive roller 10, and a next corresponding transfer abnormality is defined as a fluctuation cycle T1 of the drive roller 10. Similarly, a time interval between a transfer abnormality e.g. color unevenness, which is a failure of toner transfer, and occurs as indicated by the reference numeral 502 due to rotational fluctuation of the driven roller 11 or the tension roller 12, and a next corresponding transfer abnormality is defined as a fluctuation cycle T2 of the driven roller 11 or the tension roller 12. Then, the above arrangement enables to make timings of the fluctuation cycle T1 of the drive roller 10, and a fluctuation cycle T2 of the driven roller 11 identical to each other. The fluctuation cycle T2 of the driven roller 11 corresponds to an interval between occurrence of a transfer abnormality indicated by the reference numeral 502 due to rotational fluctuation of the driven roller 11 or the tension roller 12, and occurrence of a next corresponding transfer abnormality. It should be noted that FIG. 4 shows timings of fluctuation cycles of the drive roller 10 and the driven roller 11 in the case where the driven roller 11 makes one turn when the drive roller 10 makes one turn, in other words, the diameters of the drive roller 10 and the driven roller 11 are substantially the same with each other. In the case where the number of rotations of the driven roller 11 is an integral multiplication of the number of rotations of the drive roller 10, for example, the driven roller 11 is rotated twice when the drive roller 10 makes one turn, as described in the above example, the fluctuation cycle T2 is half as long as the fluctuation cycle T1. In this case, also, timings of the fluctuation cycles of the drive roller 10 and the driven roller 11 as a whole are coincident with each other without likelihood that positions or phases where the respective transfer abnormalities of the drive roller 10 and the driven roller 11 occur are displaced from each other as time lapses, namely, as the rotations of the drive roller 10 and the driven roller 11 progress.

The above arrangement enables to make timings of the fluctuation cycle of the drive roller 10 as a master roller, and the fluctuation cycle of the driven roller 11 or the tension roller 12 as a slave roller coincident with each other. Accordingly, even if color unevenness occurs with respect to a toner image of a certain color, color unevenness occurs substantially at the same positions i.e. at the same timings with respect to the toner images of the other colors. In other words, displacement occurs substantially at the same positions among the toner images of the four colors. This arrangement consequently enables to prevent occurrence of color displacement, namely, to cancel rotational fluctuations of the belt constituting rollers. Color displacement in this context means positional displacement in terms of correlation of the four colors.

The above equation (1) can also be expressed by the equation (1').

$$D2=N\cdot D1 \qquad (1)'$$

where D1 is a belt-inclusive outer diameter of the master roller such as the drive roller 10, including the thickness t of the belt 9, D2 is an outer diameter of the slave roller such as the driven roller 11 and the tension roller 12, and N=n or 1/n where n is a positive integer.

In the image forming apparatus or the printer in accordance with the embodiment, toner images of the respective colors are developed by the developing units 6 or the imaging sections 2M, 2C, 2Y, and 2K, the toner images of the respective colors developed by the developing units 6 are superimposedly transferred onto the surface of the belt 9, the belt 9 is driven in a state that the belt 9 is wound around the first roller such as the drive roller 10, and the second roller such as the driven roller 11 and the tension roller 12 is rotated as the belt 9 is driven by the rotation of the first roller in a state that the belt 9 is wound around the second roller. When the belt-inclusive outer diameter of the drive roller 10 including the thickness t of the belt 9 is D1, and the outer diameter of the second roller is D2, D1 and D2 satisfy the relation defined by the equation (1'). In this arrangement, the cycle of rotational fluctuation of the first roller as a master roller can be made coincident with the cycle of rotational fluctuation of the second roller as a slave roller, in other words, timings of fluctuation cycles of the first roller and the second roller can be made coincident with each other. Accordingly, even if color unevenness occurs in a toner image of a certain color during a transfer operation due to rotational fluctuation of the belt constituting roller such as the first roller and the second roller, color unevenness occurs substantially at the same positions of the toner images of the other colors as that of the toner image where the color unevenness occurred, i.e., substantially at the same timings. This arrangements enables to prevent occurrence of color displacement resulting from rotational fluctuation of the belt constituting roller, whereby a color image of high quality is obtained.

The relation defined by the equation (1') is obtained based on a condition that the running speed on the outer surface of the belt 9 where the first roller is provided, i.e., the belt surface speed V1, and the circumferential speed on the outer surface of the second roller, i.e. the driven roller surface speed V2 or the tension roller surface speed V3 be made coincident with each other. Accordingly, the relation defined by the equation (1') can be obtained by a simple technique of matching the running speed on the outer surface of the belt 9 where the first roller is provided, with the circumferential speed on the outer surface of the second roller.

The first roller corresponds to the drive roller 10 for driving the belt 9, and the second roller corresponds to the driven roller 11 which is rotated via the belt 9 by the driving rotation of the drive roller 10, or the tension roller 12 which is also rotated via the belt 9 by the driving rotation of the drive roller 10 and applies a tension to the belt 9 in a state that the belt 9 is wound around the tension roller 12. The first roller and the second roller satisfy the relation defined by the equation (1) where Dd is an outer diameter of the drive roller 10, Di is an outer diameter of the driven roller 11, Dt is an outer diameter of the tension roller 12, and t is a thickness of the belt 9. This arrangement enables to make the fluctuation cycle of the drive roller 10 as a master roller, and the fluctuation cycles of the driven roller 11 and the tension roller 12 as a slave roller coincident with each other, namely, timings of the fluctuation cycles of the drive roller 10, the driven roller 11, and the tension roller 12 coincident with each other (see FIG. 4). Accordingly, even if color unevenness occurs in a toner image of a certain color during a transfer operation due to rotational fluctuation of the belt constituting roller such as the drive roller 10, the driven roller 11, and the tension roller 12, color unevenness occurs substantially at the same positions of the toner images of the other colors as that of the toner image where the color unevenness occurred, i.e., substantially at the same timings. This arrangements enables to prevent occurrence of color displacement resulting from rotational fluctuation of the belt constituting roller, whereby a color image of high quality is obtained.

The following modifications can be applied to the invention.

(A) In the embodiment, toner images are transferred in the order of M, C, Y, and K for color tuning. Alternatively, toner images may be transferred in an arbitrary order such as Y, M, C, and K for color tuning.

(B) In the embodiment, as shown in FIG. 1, the imaging sections 2M, 2C, 2Y, and 2K are arranged at lower positions relative to the belt 9, and the tension roller 12 is arranged at an upper position relative to a lower running portion of the belt 9. Alternatively, the imaging sections 2M, 2C, 2Y, and 2K may be arranged at upper positions relative to the belt 9, and the tension roller 12 may be arranged at a lower position relative to an upper running portion of the belt 9. Further alternatively, the printer may be constructed in such a manner that the running direction of the belt 9 is opposite to the direction shown by the arrow B in FIGS. 1 and 3, namely, the left-hand direction, in place of the direction shown by the arrow B, namely, the right-hand direction.

(C) In the embodiment, two rollers i.e. the driven roller 11 and the tension roller 12 are provided as a slave roller. Alternatively, one, or more than two rollers may be provided as a slave roller. Further alternatively, two or more rollers may be provided as a master roller, unlike the embodiment, in which the single roller i.e. the drive roller 10 is provided as a master roller. In such an altered arrangement, a relation similar to the relation defined by the equation (1) or (1') is established based on a condition that the running speed on the outer surface of the belt 9 where the master rollers are provided be made coincident with the circumferential speed on the outer surface of the slave roller(s).

(D) The backup roller 13, and the anti-skew rib 91 (or the anti-skew pulley 110) may be omitted. However, it is preferable to provide these elements to stabilize a running operation of the belt 9 and to securely prevent occurrence of color displacement in combination with the technique recited in the embodiment.

(E) The embodiment adopts an arrangement, in which a toner image is indirectly transferred onto a recording sheet by way of the belt 9 as an intermediate transfer member, specifically, an arrangement, in which toner images of respective colors are superimposedly transferred onto the surface of the belt 9 to form a color image, and then the color image transferred onto the surface of the belt 9 is transferred onto a recording sheet transported over the surface of the belt 9. Alternatively, it is possible to directly transfer a color image composed of different toners onto a recording sheet by the developing units 6 by transporting the recording sheet over the surface of the belt 9, i.e., by moving the recording sheet over the surface of the belt 9 along with the belt 9, as the belt 9 is drivingly run. In such an altered arrangement, similar to the embodiment, if color unevenness occurs in a toner image of a certain color during an operation of transferring the toner image onto a recording sheet transported over the surface of the belt 9 due to rotational fluctuation of the belt constituting roller such as the first roller and the second roller, color unevenness occurs substantially at the same positions of the toner images of the other colors as that of the toner image where the color unevenness occurred, i.e., substantially at the same timings. This arrangements enables to prevent occurrence of color displacement resulting from rotational fluctuation of the belt constituting roller, whereby a color image of high quality is obtained.

To summarize the invention, the invention is directed to an image forming apparatus for forming a color image composed of a plurality of colors. The image forming apparatus comprises: a plurality of developing units for developing toner images of the respective colors; a transfer belt for superimposedly transferring the toner images of the respective colors developed by the developing units onto a surface of the transfer belt or onto a recording sheet transported over the surface of the transfer belt; a first roller for driving the transfer belt in a state that the transfer belt is wound around the first roller; and a second roller which is rotated along with the driving of the transfer belt driven by the first roller in a state that the transfer belt is wound around the second roller, wherein the image forming apparatus satisfies a relation defined by the equation (1.1)

$$D2=N\cdot D1 \tag{1.1}$$

where D1 is a belt-inclusive outer diameter of the first roller around which the transfer belt is wound, including a thickness of the transfer belt, D2 is an outer diameter of the second roller, and N=n or 1/n where n is a positive integer.

In the above arrangement, the toner images of the respective colors are developed by the developing units, and the toner images of the respective colors developed by the developing units are transferred onto the surface of the transfer belt or onto the recording sheet transported over the transfer belt. Also, the transfer belt is driven in a state that the transfer belt is wound around the first roller, and the second roller is driven along with the running of the transfer belt driven by the first roller in a state that the transfer belt is wound around the second roller. The image forming apparatus satisfies the relation defined by the equation (1.1) where D1 is the belt-inclusive outer diameter of the first roller around which the transfer belt is wound, including the thickness of the transfer belt, and D2 is the outer diameter of the second roller.

According to the above arrangement, the cycle of rotational fluctuation of the first roller as a master roller can be made coincident with the cycle of rotational fluctuation of the second roller as a slave roller, in other words, timings of fluctuation cycles of the first roller and the second roller can be made coincident with each other. Accordingly, even if color unevenness occurs in a toner image of a certain color during a transfer operation due to rotational fluctuation of a belt constituting roller such as the first roller and the second roller, color unevenness occurs substantially at the same positions of the toner images of the other colors as that of the toner image where the color unevenness occurred, i.e., substantially at the same timings. This arrangements enables to prevent occurrence of color displacement resulting from rotational fluctuation of the belt constituting roller, whereby a color image of high quality is obtained.

Preferably, the relation defined by the equation (1.1) is obtained based on a condition that a running speed on an outer surface of the transfer belt where the first roller is provided, and a circumferential speed on an outer surface of the second roller be made coincident with each other.

According to the above arrangement, the relation defined by the equation (1.1) is obtained based on the condition that the running speed on the outer surface of the transfer belt where the first roller is provided, and the circumferential speed on the outer surface of the second roller be made coincident with each other. Accordingly, the relation defined by the equation (1.1) can be obtained by a simple technique of matching the running speed on the outer surface of the transfer belt where the first roller is provided with the circumferential speed on the outer surface of the second roller.

Preferably, the first roller includes a drive roller for driving the transfer belt, the second roller includes a driven roller which is rotated by way of the transfer belt by the rotation of the drive roller, and a tension roller which is rotated by the rotation of the drive roller and applies a tension to the transfer belt in a state that the transfer belt is wound around the tension roller, and the image forming apparatus satisfies a relation defined by the equation (1.2)

$$Di=Dt=N\cdot(Dd+2t) \tag{1.2}$$

where Dd is an outer diameter of the drive roller, Di is an outer diameter of the driven roller, Dt is an outer diameter of the tension roller, t is the thickness of the transfer belt, and N=n or 1/n where n is a positive integer.

In the above arrangement, the first roller includes the drive roller for driving the transfer belt, and the second belt includes the driven roller which is rotated by way of the transfer belt by the rotation of the drive roller, and a tension roller which is rotated by the rotation of the drive roller for applying a tension to the transfer belt in a state that the transfer belt is wound around the tension roller, Also, the image forming apparatus satisfies the relation defined by the equation (1.2) where Dd is the outer diameter of the drive roller, Di is the outer diameter of the driven roller, Dt is the outer diameter of the tension roller, t is the thickness of the transfer belt, and N=n or 1/n where n is a positive integer.

According to the above arrangement, the cycle or rotational fluctuation of the driver roller as the master roller, and the cycle of rotational fluctuation of the driven roller and the tension roller as the slave roller can be made coincident with each other. Accordingly, even if color unevenness occurs in a toner image of a certain color during a transfer operation due to rotational fluctuation of the belt constituting roller such as the drive roller, the driven roller, and the tension roller, color unevenness occurs substantially at the same positions of the toner images of the other colors as that of the toner image where the color unevenness occurred, i.e., substantially at the same timings. This arrangements enables to prevent occurrence of color displacement resulting from rotational fluctuation of the belt constituting roller, whereby a color image of high quality is obtained.

This application is based on Japanese Patent Application Nos. 2005-213359 and 2005-317966 respectively filed on Jul. 22, 2005 and Nov. 1, 2005, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus for forming a color image composed of a plurality of colors, comprising:

a plurality of developing units for developing toner images of the respective colors;

a transfer belt for superimposedly transferring the toner images of the respective colors developed by the developing units onto a surface of the transfer belt or onto a recording sheet transported over the surface of the transfer belt;

a first roller for driving the transfer belt in a state that the transfer belt is wound around the first roller; and a second roller which is rotated along with the driving of the transfer belt driven by the first roller in a state that the transfer belt is wound around the second roller, wherein the image forming apparatus satisfies a relation defined by the equation (1.1)

$$D2=N\cdot D1 \tag{1.1}$$

where D1 is a belt-inclusive outer diameter of the first roller around which the transfer belt is wound, including a thickness of the transfer belt, D2 is an outer diameter of the second roller, and N=n or 1/n where n is a positive integer.

2. The image forming apparatus according to claim 1, wherein the relation defined by the equation (1.1) is obtained based on a condition that a running speed on an outer surface of the transfer belt where the first roller is provided, and a circumferential speed on an outer surface of the second roller be made coincident with each other.

3. The image forming apparatus according to claim 1, wherein the first roller includes a drive roller for driving the transfer belt, the second roller includes a driven roller which is rotated by way of the transfer belt by the rotation of the drive roller, and a tension roller which is rotated by the rotation of the drive roller and applies a tension to the transfer belt in a state that the transfer belt is wound around the tension roller, and the image forming apparatus satisfies a relation defined by the equation (1.2)

$$Di=Dt=N\cdot(Dd+2t) \tag{1.2}$$

where Dd is an outer diameter of the drive roller, Di is an outer diameter of the driven roller, Dt is an outer diameter of the tension roller, t is the thickness of the transfer belt, and N=n or 1/n where n is a positive integer.

* * * * *